US005117651A

United States Patent [19]

Suh

[11] Patent Number: 5,117,651

[45] Date of Patent: Jun. 2, 1992

[54] DEHUMIDIFIER

[75] Inventor: Jung G. Suh, Seoul, Rep. of Korea

[73] Assignee: Samsung Electronics Co. Ltd., Seoul, Rep. of Korea

[21] Appl. No.: 466,401

[22] PCT Filed: Jul. 26, 1989

[86] PCT No.: PCT/KR89/00010

§ 371 Date: Feb. 28, 1990

§ 102(e) Date: Feb. 28, 1990

[87] PCT Pub. No.: WO90/01132

PCT Pub. Date: Feb. 8, 1990

[30] Foreign Application Priority Data

Jul. 26, 1988 [KR] Rep. of Korea ..... 12033/88

[51] Int. Cl.[5] ..... F25D 21/14

[52] U.S. Cl. ..... 62/288; 62/289

[58] Field of Search ..... 62/288, 289, 285

[56] References Cited

U.S. PATENT DOCUMENTS

| | | | |
|---|---|---|---|
| 2,369,511 | 2/1945 | Winkler | 62/288 |
| 2,630,691 | 3/1953 | Harris et al. | 62/288 |
| 2,747,383 | 5/1956 | Schlumbohm | 62/288 X |
| 4,347,782 | 9/1982 | Hoecke | 98/33 A |
| 4,712,382 | 12/1987 | Le Clear | 62/288 X |

FOREIGN PATENT DOCUMENTS 55-56334 4/1980 Japan .

*Primary Examiner*—Lloyd L. King

*Attorney, Agent, or Firm*—Sterne, Kessler, Goldstein & Fox

[57] ABSTRACT

A dehumidifier in the form of a circular or a multisides for intaking the wet air from at least three sides of the lower portion and blowing the dehumidified air out of only one direction of the upper portion to occur the convection circulating of the air flow to enhance the dehumidifying effect.

8 Claims, 4 Drawing Sheets

DEHUMIDIFIER

TECHNICAL FIELD

The present invention is related to providing a dehumidifier, particularly to providing a dehumidifier in the form of a circular or a multi-sides for intaking the wet air from at least three sides of the lower portion and blowing the dehumified air out of only one direction of the upper portion to occur the convection circulating of the air flow, thereby enhancing the dehumidifying effect.

BACKGROUND ART

The conventional dehumidifier sucks the wet air in the indoor, makes the moisture in the air contacting with the cooled surface of the evaporator form a drop of the water and feeds the dehumidified air with being heated/dried near the room temperature by means of the condenser. In order to perform this operation the refrigeration cycle using the commercial name "Freon R-12" has been adapted to the dehumidifier.

The prior art using these refrigeration cycle was disclosed in Japan Laid Open Publication Sho 55-56334 which has the configuration similar to the apparatus of FIG. 1. As shown in FIG. 1, evaporator 3, condenser 4 and circulating fan motor 5 are aligned in the horizontal arrangement, in the manner that it intakes the wet air from the front or rear side and discharges the dried air out of the front or other side.

Therefore, the conventional apparatus of FIG. 1 decreases the dehumidifying efficiency due to it that if intaking grill 6 is closely positioned near the wall or the furniture the intaking efficiency of the air is significantly reduced. Also, the discharge of the dried air passing through discharging grill 7 is performed in the horizontal direction, with a result that the hot air is directly contacted with the human body to feel uncomfortable. According to circumstances, the furniture made of the wood is directly exposed to the hot dried air thereby to be cracked or distorted partly.

Also, this dehumidifier has numerous disadvantages in respect that its configuration is not resonable and the dehumidifying effect is reduced, for the hot dried air discharged therefrom is directed in the horizontal and then raised only to allow it to be mixed with the wet air.

Similarly, Japan Laid Open Patent Publication Sho 55-56334 has the disadvantage that on the way of the air circulating the dried air and the wet air are mixed in the predetermined distance remote from the dehumidifier.

Considering these points, in order to enhance the dehumidifying efficiency the problem of energy conservation may be paid much attentions. Particularly, the problem of heating large enclosed spaces such as commercial buildings, industrial plants and the like has attracted a large amount of attention wherever the comfort of personnel is to be maintained. Air circulation within a large enclosed space to be heated is the well-recognized manner of raising the temperature of the low-lying ambient air, it being known since the earliest times that warm air in a large enclosed space rises above cool air and collects near roofs, with a result that the enclosed space could not be wholly kept in the uniform temperature.

In order to resolve these problems, the air recirculator disclosed in U.S. Pat. No. 4,347,782 is constructed in a manner to adjust the air velocity and the direction of effluent air from the recirculator's air outlets. so that the air is recirculated to raise air temperature near the floor in winter and to provide a direct flow of air blown generally horizontally slightly above persons standing on the floor in summer. That is, a fan assembly is housed in a unitary duck-like housing which is open near its base to take in air. The duck-like housing is capped with an outlet hood which adjustably telescopes on the housing so that air flow from openings in the outlet hood can be adjusted for winter or summer operation.

Herein, it is known that the whole air in the enclosed indoor is distributed to have the uniform temperature basing the air recirculation being on the air convection, and the recirculator is preferable to be in form of the duck-like housing.

Accordingly, the main object of the present invention is to provide a dehumidifier restraining the rising of the air temperature at its maximum, which is adapted to a duck-type housing for receiving the wet air from its lower and blowing the dried air out of its upper to radiate hot heat thorugh the ceil or the window.

The other object of the present invention is to provide a dehumidifier constructing the evaporator, the condenser and the fan motor in the vertical arrangement in order to realize the effective refrigeration cycle.

The another object of the present invention is to provide a dehumidifier having an evaporator in form of a circular cone in order to increase the refrigeration cycle efficiency.

DISCLOSURE OF INVENTION

In order to achieve these objects, the present invention comprises as follows;

a cabinet or housing being in the form of a circular or muti-surfaces having an obtuse angle and having a intaking portion extending downwardly from the middle of its height to a water drain to effectively intake the wet air and a discharging portion forming on the cap portion of its upper to upwardly blow the dried air therefrom, a lower structure provided with a water collecting bucket and a compressor arranged in proper below said water drain slanted toward any one place on which the hole is perforated, an evaporator having a configuration of a circular cone which is installed near over said air intaking portion, a condenser mounted adjacent to said evaporator in the upper portion of the housing, a fan motor assembly mounted near the lower of the cap portion having the dried air discharging portion over said condenser, wherein said evaporator, said condenser and fan motor assembly are mounted in the vertical arrangement in said housing while said evaporator is in the form of a circular cone with its body being wound like the coil to be narrowed from the upper to the lower.

Accordingly, the present invention generates the air convection in the enclosed space with a result that the wet air from the intaking portion is passed through the evaporator and the condenser to generate the dried air, and the dried air is blown out of the discharging portion of the cap portion.

The present invention prohibits the rising of the temperature in the room at its maximum with a result that the hot dried air discharged from the cap portion is firstly radiated heat by the convection phenomena through the ceil or the window.

Also, the present invention restricts at its maximum not to mix the dried air with the wet air due to the difference between the directions of the air intaking and discharging as well as makes the user avoid the uncomfortability and the deformation of the wood furniture caused by contacting with the hot air.

Especially, the present invention is provided with the circular cone type evaporator so that it rises the dehumidifying efficiency over the conventional dehumidifier having the threaded evaporator.

If a dehumidifier is provided with the threaded evaporator, this evaporator is supported in the horizontal state, so that a drop of water formed on the surface of the evaporator is attached, as it is, to the evaporator until its weight is reached to the predetermined weight. As a consequence, this drop of water plays a role like a heat resisting material for disturbing the heat exchange between the evaporator and the wet air, so that the dehumidifying efficiency may be reduced.

But, the evaporator of the present invention is constructed in the form of a circular cone to have the slanting surface so that a drop of water formed thereon flow downward along the slanting surface and is easy to be dropped at the end of the circular cone. Thus it has a advantage that the heat resisting effect is reduced to enhance the dehumidifying efficiency.

BRIEF DESCRIPTION OF DRAWINGS

The above and other objects of the present invention will be seen by the following description taken in connection with the accompany drawings, in which.

BEST MODE FOR CARRYING OUT INVENTION

Figure 1:
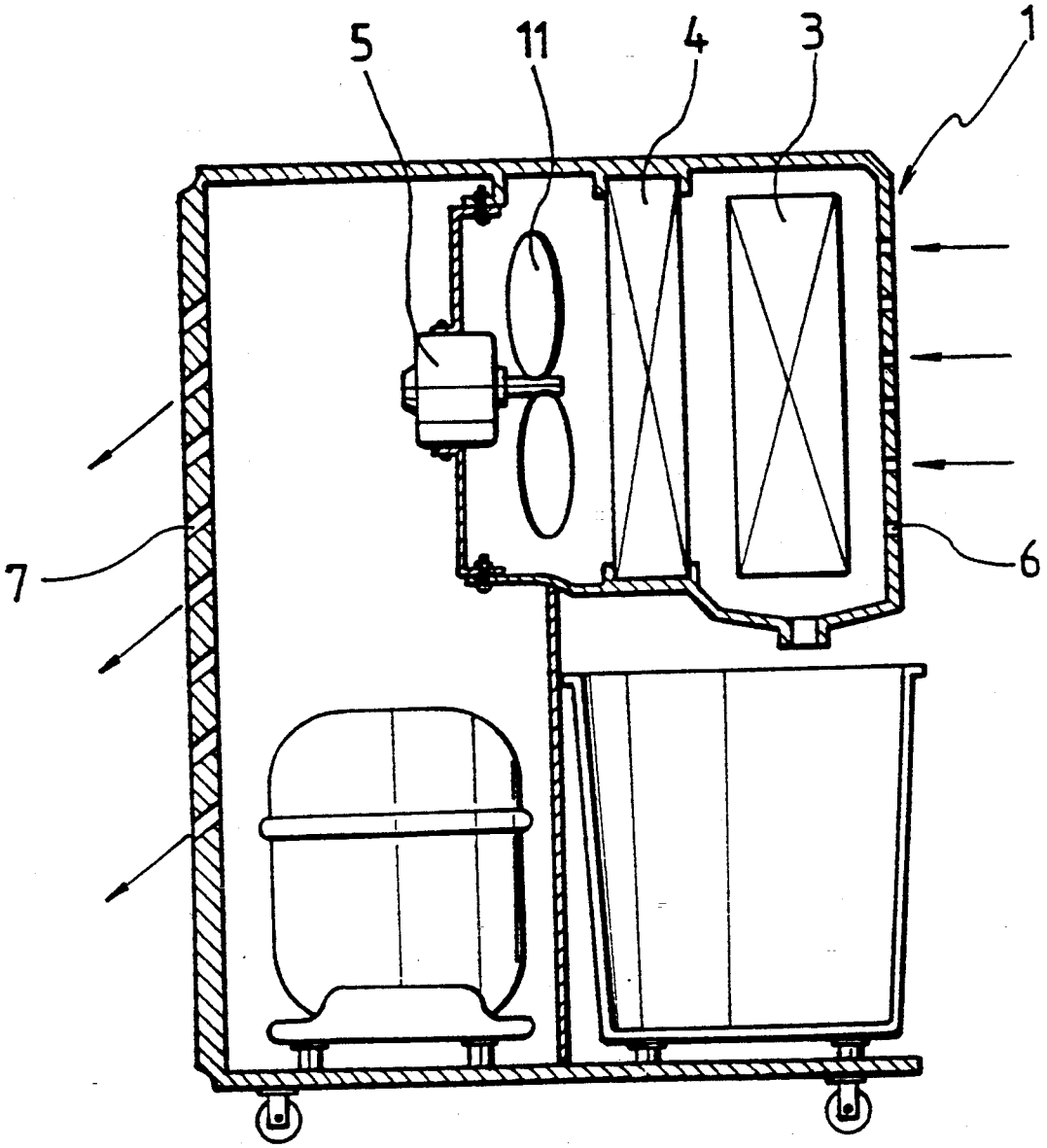
FIG 1 PRIOR ART
FIG. 1 is a view showing the schematical structure of the dehumidifier constructed according to the prior art.

As shown in drawings, the present invention comprises dehumidifier 1 provided with compressor 2, evaporator 3, condenser 4 and fan motor assembly 5. Body or cabinet 1*a* of dehumidifier 1 may be made in the form of the cylindrical or the multi-surfaces having an abtuse angle. Grill 6 is formed as the intaking port through over ¾ portion on the periphery of cabinet 1*a* extending downward from the middle portion of cabinet 1*a* to near the upper of the water collecting bucket 9 as described below in detail, Discharging grill 7 is formed on the upper of the cap portion to blow the dried air upward out of the cap portion. Drain plate 8 is coupled by means of the predetermined means to the inner surface of the cabinet 1*a* directly below grill 6. This drain plate 8 is provided with hole 12 formed at the predetermined eccentric position to pass through the condensed water and the slanting surface extending toward hole 12 from its periphery. Compressor 2 and water collecting bucket 9 are appropiately arranged below drain plate 8 so that bucket 9 is removed from cabinet 1*a* or inserted thereinto. Evaporator 3 is mounted to place its lower near the upper of the intaking grill with its upper being supported by means of the fixing bracket, in which the diameter of its upper is identical to that of the inner in cabinet 1*a*, and further its body is wounded downward in turns over three steps in the form of the coil to make the circular cone-like structure. Also, capillary tube 10 and four directional switching valve (not shown) are fixed over evaporator 3 to the predetermined position of cabinet 1*a*, and threaded condenser 4 is appropriately mounted by means of the bracket and like in cabinet 1*a*. Fan motor assembly is provided with fan 11 and motor 5, which is mounted by means of the fixing bracket near the lower of grill 7 over condenser 4.

Herein, it is noted that evaporator 3, condenser 4 and fan 11 and motor 5 of the fan motor assembly are installed in cabinet 1*a* in the vertical arrangement.

The acting effect of the present invention as described above will be explained below in detail.

Figure 2:
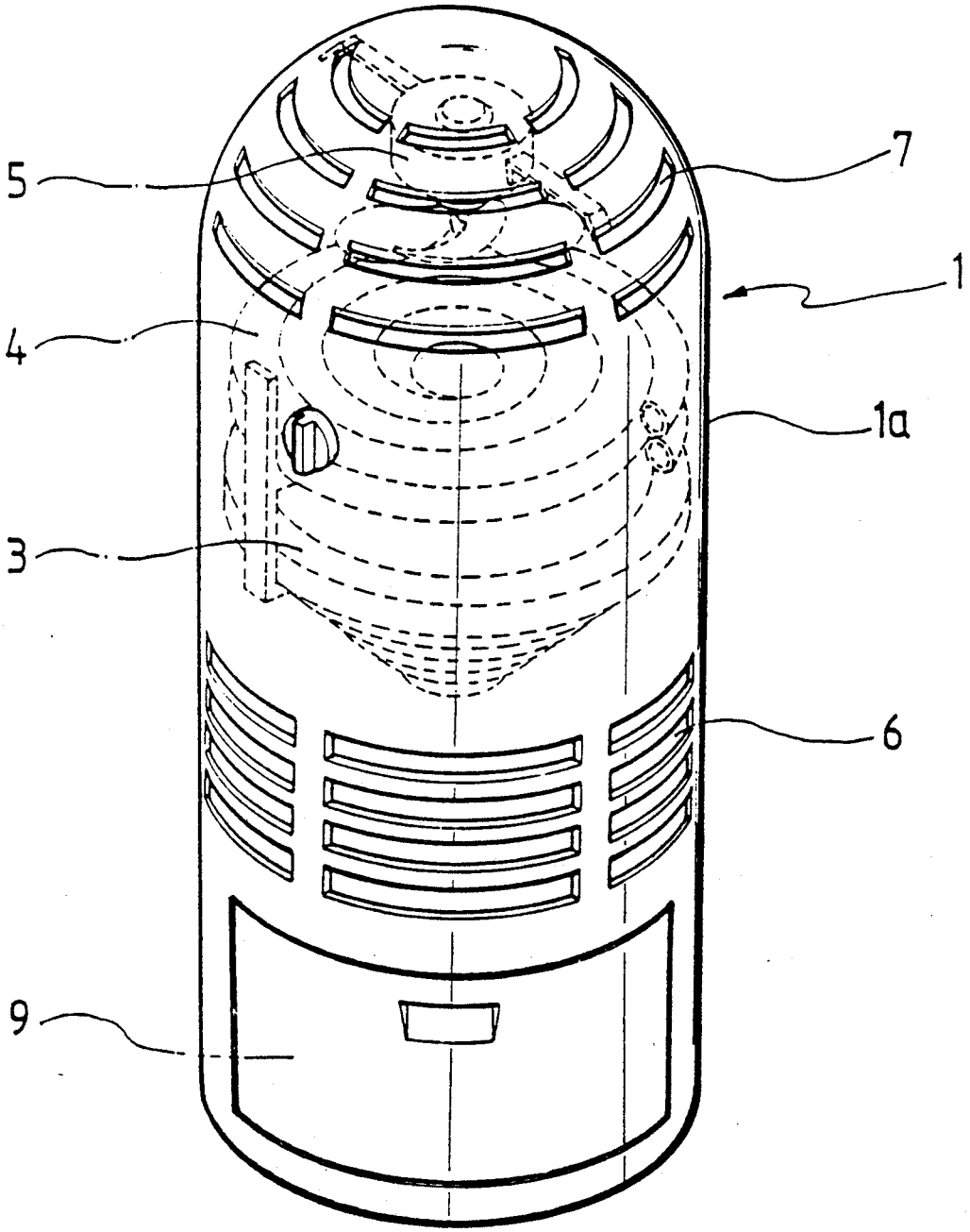
FIG. 2 is a whole perspective view showing the inner configuration of the present invention in phantom line.
Figure 3:
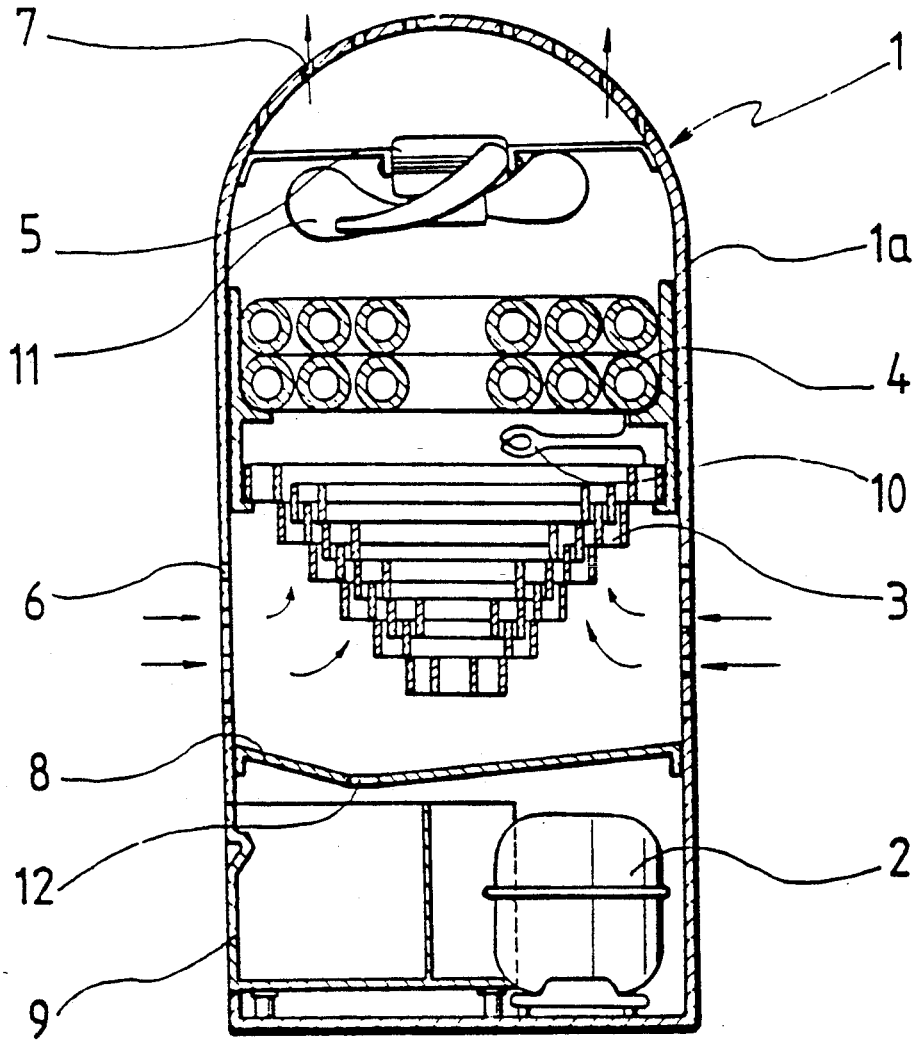
FIG. 3 is a side crosssectional view showing the whole configuration of the present invention.
Figure 4:
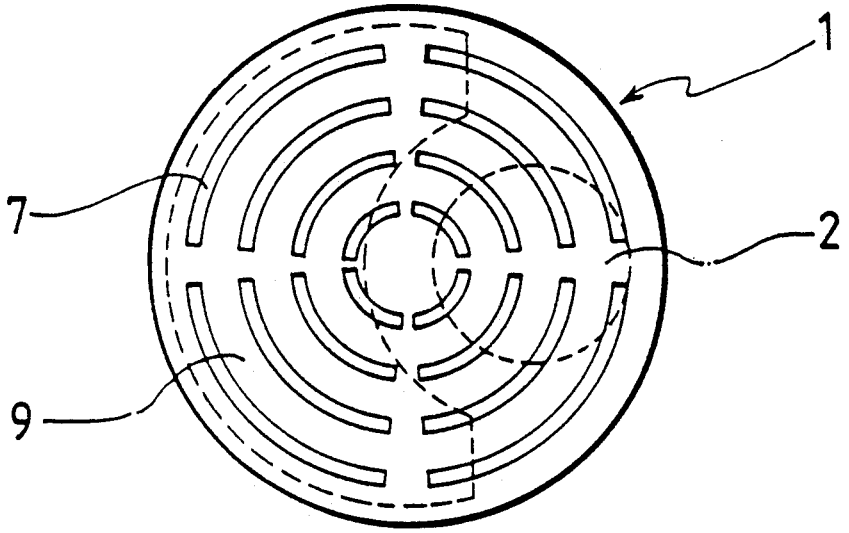
FIG. 4 is a view showing one embodiment of the discharging port forming on the cap portion of the present invention.
Figure 5:
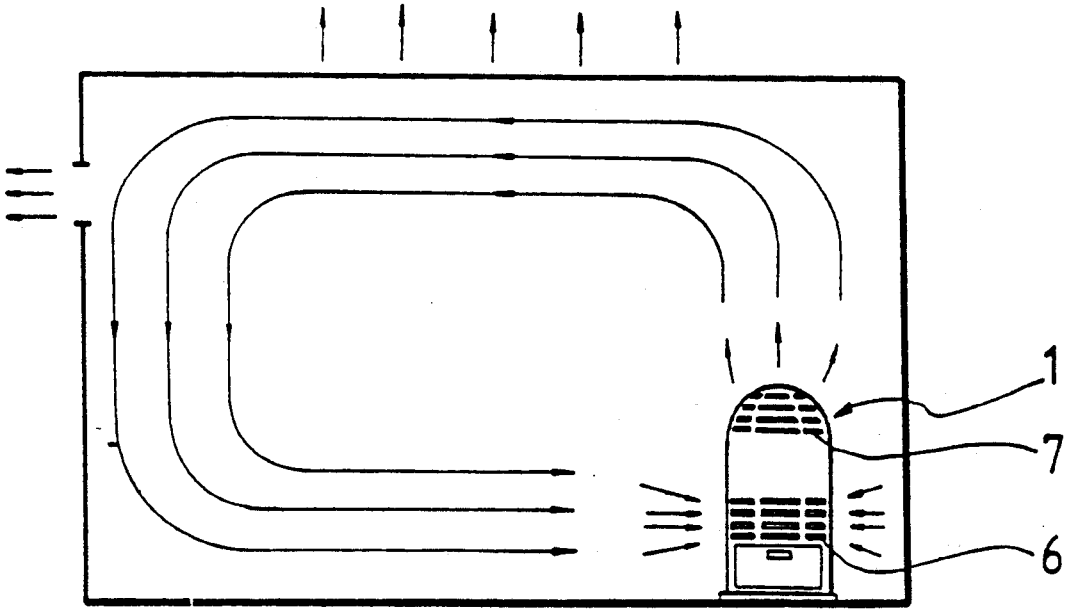
FIG. 5 is a schematical view explaining the operating principle of the present invention.

The refrigerant compressed at compressor 2 is condensed at threaded condenser 4 to be turn to liquid as well as to be radiated heat, evaporated as evaporator 3 to condense the moisture included in the air, and again circulated to compressor 2. That is to say, dehumidifier 1 of the present invention uses the refrigeration cycle which the operation of the compression, the condensation, the expansion, the evaporation and the compression is performed in turns. But, the present invention as shown in FIG. 2 or FIG. 3 comprises defumidifier 1, in which its cabinet is in the form of the cylindrical, intaking grill 6 is formed to intake the wet air from at least one sides of the middle portion on the periphery of cabinet 1*a* and discharging grill 7 is formed to blow the dried upward out of the cap portion, condenser 4 and evaporator 3 connected through capillary tube 10 to each other are mounted in cabinet 1*a* at the vertical arrangement. Thus, when the user operates this dehumidifier 1, circulating fan motor 5 is driven to intake the wet air in the indoor from intaking grill 6 formed on the periphery of cabinet 1*a* by means of fan 11. The intaken air is passed through evaporator 3 being kept in the relative lower temperature state and condenser 4 being maintained in the relative higher temperature state is condensed on the surface of condenser 4 to be turn to liquid and then dropped through hole 12 formed on drain plate 8 into bucket 9 positioned at the lower of cabinet 1*a*. At that time, the air dried by the dehumidifing acting absorbs the heat of condenser 4 to be heated by near the ambient temperature of the indoor, and then to be blown upward out of the upper of cabinet 1*a* through discharging grill 7. Thus, the present invention smoothly generates the convection circulation at the resonable level due that the hot dried air is restrained at its maximum not to be mixed with the heavy wet air.

That is, due that the air intaken from the lower of cabinet 1*a* is blown upward at near the room temperature out of the cap portion, this air is firstly radiated heat through the cell or the window during the convection circulating to keep the indoor in the confortable state.

Also, due that evaporator 3 is in the form of a circular cone, the air intaken through grill 6 on the periphery of cabinet 1*a* is impinged against the relative winder area contacting with the slanting surface of the evaporator. Thus, a relative larger amount of air may be cooled over the conventional threaded evaporator for getting the air to go past the evaporator thereby to cool the air, while a drop of water may be effectively formed to enhance the heat exchanging efficiency.

As described above, due that the shape of dehumidifier is cylindrical or the multi-surface type having an abtuse angle to allow the air to be intaken from at least three surface of the cabinet as well as to perform the upward discharging of the dehumidified air, the present invention prevents the reduction of the intaking efficiency in spite of a positioning near the wall or the wood furniture, thereby faciliating its position to be established. Also, due that the discharging air is radiated heat through the ceil or the window, the uncomfortablity and the deformation of the wood furniture caused by being contracted with the hot dried air may be avoided. The indoor may be kept in the confortable state due to preventing the raising of the room temperature. Thus, the present invention can obtains the maximum dehumidifying effenccy even at any portion of the indoor.

I claim:

1. An apparatus for efficiently dehumidifying room air while maintaining a confortable room temperature and preventing the deformation of wood furniture, the apparatus comprising:

(a) a cylindrical housing having a dome-like top;

(b) an air discharging grill at said dome-like top, said discharging grill for discharging air outward and substantially upward;

(c) a fan motor in said cylindrical housing and below said air discharging portion, said fan motor for blowing air out of said housing via said discharging grill;

(d) condenser situated below said fan motor;

(e) a circular cone-like evaporator connected to said condenser and situated below said condenser;

(f) an air intaking grill in the periphery of said housing and in horizontal alignment with said evaporator;

(g) a means for collecting water below said evaporator; and (h) a compressor situated below said means for collecting water and connecting said condenser and said evaporator.

2. The apparatus of claim 1, wherein said circular cone-like evaporator is positioned so that said diameter increases vertically upward.

3. The apparatus of claim 1, wherein said circular cone-like evaporator is positioned so that said diameter increases vertically downward.

4. The apparatus of claim 1, further comprising an integrally formed fixing means for fixing said evaporator and said condenser to the inner periphery of said housing.

5. The apparatus of claim 1, wherein said means for collecting water comprises a drain plate affixed to said housing and having a drain hole and wherein said apparatus further comprises a bucket situated below said drain hole of said drain plate and adjacent to said compressor.

6. The apparatus of claim 1, wherein said intaking grill comprises at least three discrete portions so as to intake air from at least three directions.

7. The apparatus of claim 2, wherein said circular cone-like evaporator comprises a coil which is wound downward in turns thereby forming at least three steps.

8. The apparatus of claim 5, wherein said drain plate is positioned sufficiently away from said evaporator so as to prevent heat generated during the operation of said compressor from influencing said evaporator.

* * * * *